US006975343B2

(12) United States Patent
Mindler et al.

(10) Patent No.: US 6,975,343 B2
(45) Date of Patent: Dec. 13, 2005

(54) PREVENTING CREASE FORMATION IN DONOR WEB IN DYE TRANSFER PRINTER THAT CAN CAUSE LINE ARTIFACT ON PRINT

(75) Inventors: Robert F. Mindler, Churchville, NY (US); Zhanjun Gao, Rochester, NY (US); Po-Jen Shih, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 9 days.

(21) Appl. No.: 10/760,860

(22) Filed: Jan. 20, 2004

(65) Prior Publication Data

US 2005/0157158 A1 Jul. 21, 2005

(51) Int. Cl.[7] ..... B41J 17/30
(52) U.S. Cl. ..... 347/215; 347/220; 400/247
(58) Field of Search ..... 347/215, 216, 347/217, 220; 400/648, 649, 652, 659, 661.3, 400/662, 247, 248

(56) References Cited

U.S. PATENT DOCUMENTS

| | | | | |
|---|---|---|---|---|
| 4,893,134 | A | 1/1990 | Yamamoto et al. | |
| 6,762,783 | B1 * | 7/2004 | Gao et al. | 347/216 |
| 6,768,503 | B1 * | 7/2004 | Shih et al. | 347/216 |
| 6,812,945 | B2 * | 11/2004 | Gao et al. | 347/216 |

FOREIGN PATENT DOCUMENTS

| | | |
|---|---|---|
| JP | 56-028880 | 3/1981 |
| JP | 59-068282 | 4/1984 |
| JP | 60-157889 | 8/1985 |
| JP | 07-178993 | 7/1995 |
| JP | 08-230262 | 9/1996 |

* cited by examiner

*Primary Examiner*—Huan Tran
(74) *Attorney, Agent, or Firm*—Mark G. Bocchetti

(57) ABSTRACT

A thermal printer is adapted to prevent crease formation in a dye transfer area of a dye donor web that can cause line artifacts to be printed on a dye receiver during a dye transfer from the dye transfer area to the dye receiver in a dye transfer printer.

14 Claims, 9 Drawing Sheets

1

PREVENTING CREASE FORMATION IN DONOR WEB IN DYE TRANSFER PRINTER THAT CAN CAUSE LINE ARTIFACT ON PRINT

CROSS-REFERENCE TO RELATED APPLICATIONS

Cross-reference is made to commonly assigned, co-pending applications Ser. No. 10/392,502, entitled PREVENTING CREASE FORMATION IN DONOR WEB IN DYE TRANSFER PRINTER THAT CAN CAUSE LINE ARTIFACT ON PRINT, and filed Mar. 20, 2003 in the names of Zhanjun J. Gao, John F. Corman and Robert F. Mindler, Ser. No. 10/394,888, entitled PREVENTING CREASE FORMATION IN DONOR WEB IN DYE TRANSFER PRINTER THAT CAN CAUSE LINE ARTIFACT ON PRINT, and filed Mar. 21, 2003 in the names of Zhanjun J. Gao, Robert F. Mindler and Po-Jen Shih, and Ser. No. 10/426,591, entitled PREVENTING CREASE FORMATION IN DONOR WEB IN DYE TRANSFER PRINTER THAT CAN CAUSE LINE ARTIFACT ON PRINT, and filed Apr. 30, 2003 in the names of Zhanjun J. Gao, Robert F. Mindler and Po-Jen Shih.

FIELD OF THE INVENTION

The invention relates generally to dye transfer or thermal printers. More particularly, the invention relates to the problem of creases or wrinkles being formed in the dye transfer areas of a dye donor web during dye transfer printing. Crease formation in a dye transfer area can result in an undesirable line artifact being printed on a dye receiver.

BACKGROUND OF THE INVENTION

A typical multi-color dye donor web that is used in a dye transfer or thermal printer is substantially thin and has a repeating series of three different rectangular-shaped color sections or patches such as a yellow color section, a magenta color section and a cyan color section. In addition, there may be a transparent colorless laminating section immediately after the cyan color section.

Each color section of the dye donor web consists of a dye transfer area which is used for dye transfer printing and a pair of opposite longitudinal edge areas alongside the dye transfer area which are not used for printing. Often, the dye transfer area is about 152 mm wide and the two edge areas are each about 5.5 mm wide, so that the total web width is approximately 163 mm.

To make a multi-color image print using a thermal printer, a motorized donor web take-up spool draws a longitudinal portion of the dye donor web off a donor web supply spool in order to successively move an unused single series of yellow, magenta and cyan color sections over a stationary bead of selectively heated resistive elements on a thermal print head between the supply and take-up spools. Respective color dyes within the yellow, magenta and cyan color sections are successively heat-transferred, via the selectively heated resistive elements, onto a dye receiver medium such as a paper or transparency sheet or roll, to form the color image print. The selectively heated resistive elements often extend across the entire width of a color section, i.e. across the dye transfer area and the two longitudinal edge areas comprising that color section. However, only those resistive elements that contact the dye transfer area are selectively heated. Those resistive elements that contact the two longitudinal edge areas are not heated. Consequently, the dye transfer occurs from the dye transfer area to the dye receiver medium, but not from the two longitudinal edge areas to the dye receiver medium.

As each color section is drawn over the selectively heated resistive elements, it is subjected to a longitudinal tension particularly by the forward pulling force of the motorized donor web take-up spool. Since the dye transfer area in the color section is heated by the resistive elements, but the two longitudinal edge areas alongside the dye transfer area are not, the dye transfer area is significantly weakened and therefore vulnerable to stretching as compared to the two longitudinal edge areas. Consequently, the longitudinal tension will stretch the dye transfer area relative to the two longitudinal edge areas. This stretching causes the dye transfer area to become thinner than the non-stretched edge areas, which in turn causes some creases or wrinkles to develop in the dye transfer area, mostly in those regions of the dye transfer area that are close to the non-stretched longitudinal edge areas. The creases or wrinkles occur mostly in the regions of the dye transfer area that are close to the non-stretched edge areas because of the sharp, i.e. abrupt, transition between the stretched transfer area and the non-stretched edge areas. Moreover, the creases tend to be slanted diagonally across such regions of the stretched transfer area.

As the dye donor web is pulled by the motorized donor web take-up spool over the selectively heated resistive elements, the creases or wrinkles tend to spread from a trailing (rear) end portion of a used dye transfer area at least to a leading (front) end portion of the next dye transfer area to be used. A known problem that can result is that the creases in the leading (front) end portion of the next dye transfer area to be used will cause undesirable line artifacts to be printed on a leading (front) end portion of the dye receiver medium. The line artifacts printed on the dye receiver medium are relatively short, but quite visible.

The question presented therefore is how to solve the problem of the creases or wrinkles being created in an unused transfer area so that no line artifacts are printed on the dye receiver medium during the dye transfer.

THE CROSS-REFERENCED APPLICATIONS

The cross-referenced applications each disclose a thermal printer capable of preventing crease formation in a dye transfer area of a dye donor web that can cause line artifacts to be printed on a dye receiver during a dye transfer from the dye transfer area to the dye receiver.

To prevent crease formation, cross-referenced application Ser. No. 10/392,502 discloses a pair of conical-shaped web-spreading rollers positioned to extend diagonally across at least the regions of the dye transfer area in which there can be crease formation. The web-spreading rollers oppose crease formation in such regions by urging the regions to spread.

Cross-referenced application Ser. No. 10/394,888 discloses a single web-spreading roller on which fibers are diagonally wound approximately 45° inwardly towards one another from coaxial opposite ends of the roller. The diagonal fibers oppose crease formation in the regions of the dye transfer area in which there can be crease formation by urging such regions to spread.

Cross-referenced application Ser. No. 10/426,591 discloses a web-spreading roller having an opposed pair of resilient helical ribs that spiral inwardly to one another from coaxial opposite ends of the roller. When a dye transfer area is longitudinal tensioned, the ribs are deformed away from one other towards the opposite ends of the roller to prevent the onset of crease formation.

SUMMARY OF THE INVENTION

According to one aspect of the invention, there is provided a novel thermal printer capable of preventing crease formation in a dye transfer area of a dye donor web that can cause line artifacts to be printed on a dye receiver during a dye transfer from the dye transfer area to the dye receiver. The thermal printer comprises:

a thermal print head adapted to heat the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas to possibly form creases extending at least across respective regions of the dye transfer area adjacent the two edge areas; and a crease-preventing web roller that is bowed at least against the two edge areas of the dye donor web to urge the regions of the dye transfer area in which the creases can form to spread in opposition to the onset of creases in such regions.

Preferably, the web roller includes a coaxial core with relatively weak portions that extend along the core inwardly from opposite coaxial ends of the core and with a relatively strong intermediate portion between the weak portions. This allows the weak core portions to be independently bent from the strong core portion towards the two edge areas of the dye donor web and the regions of the dye transfer area in which the creases can form.

According to another aspect of the invention, there is provided a novel method in a thermal printer of preventing crease formation in a dye transfer area of a dye donor web that can cause line artifacts to be printed on a dye receiver during a dye transfer from the dye transfer area to the dye receiver. The method comprises:

heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas to possibly form creases extending at least across respective regions of the dye transfer area adjacent the two edge areas; and bowing a crease-preventing web roller at least against the two edge areas of the dye donor web to urge the regions of the dye transfer area in which the creases can form to spread in opposition to the onset of creases in such regions.

DETAILED DESCRIPTION OF THE INVENTION

Dye Donor Web

Figure 1:
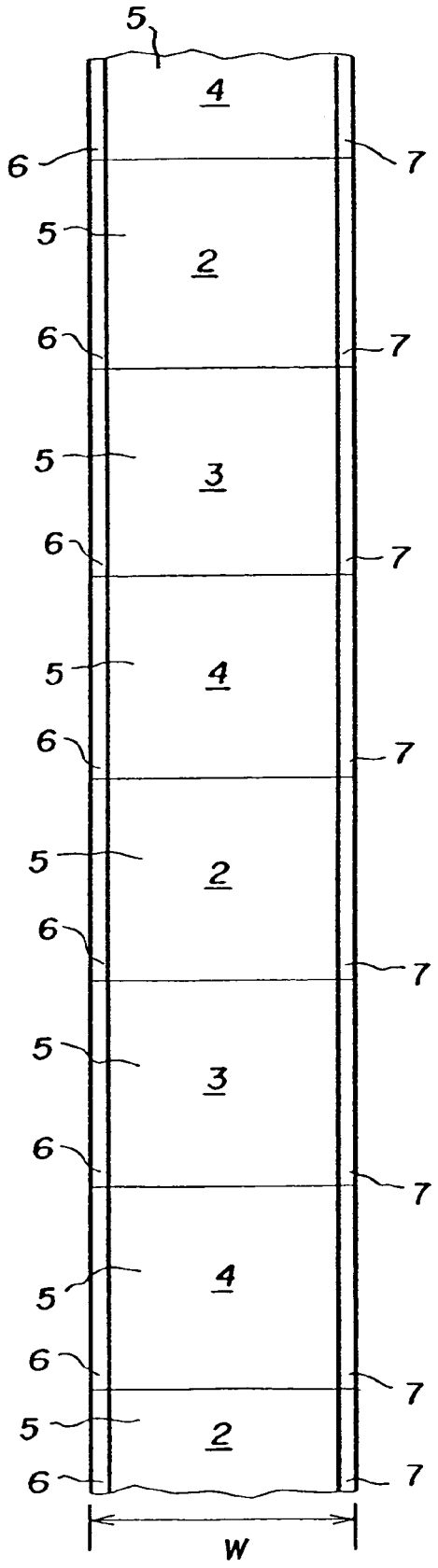
FIG. 1 is plan view of a typical dye donor web including successive dye transfer areas and opposite longitudinal edge areas alongside each one of the dye transfer areas.

FIG. 1 depicts a typical multi-color dye donor web or ink ribbon 1 that is used in a dye transfer or thermal printer. The dye donor web 1 is substantially thin and has a repeating series (only two completely shown) of three different rectangular-shaped color sections or patches such as a yellow color section 2, a magenta color section 3 and a cyan color section 4. In addition, there may be a transparent laminating section (not shown) immediately after the cyan color section 4.

Each yellow, magenta or cyan color section 2, 3 and 4 of the dye donor web 1 consists of a yellow, magenta or cyan dye transfer area 5 which is used for printing and a pair of similar-colored opposite longitudinal edge areas 6 and 7 alongside the dye transfer area which are not used for printing. Preferably, the dye transfer area 5 is about 152 mm wide and the two edge areas 6 and 7 are each about 5.5 mm wide, so that the total web width W is approximately 163 mm.

Dye Transfer or Thermal Printer

FIGS. 2–6 depict operation of a dye transfer or thermal printer 10 using the dye donor web 1 shown in FIG. 1 to effect successive yellow, magenta and cyan dye transfers onto a known dye receiver sheet 12 such as paper or a transparency.

Initialization

Figure 2:
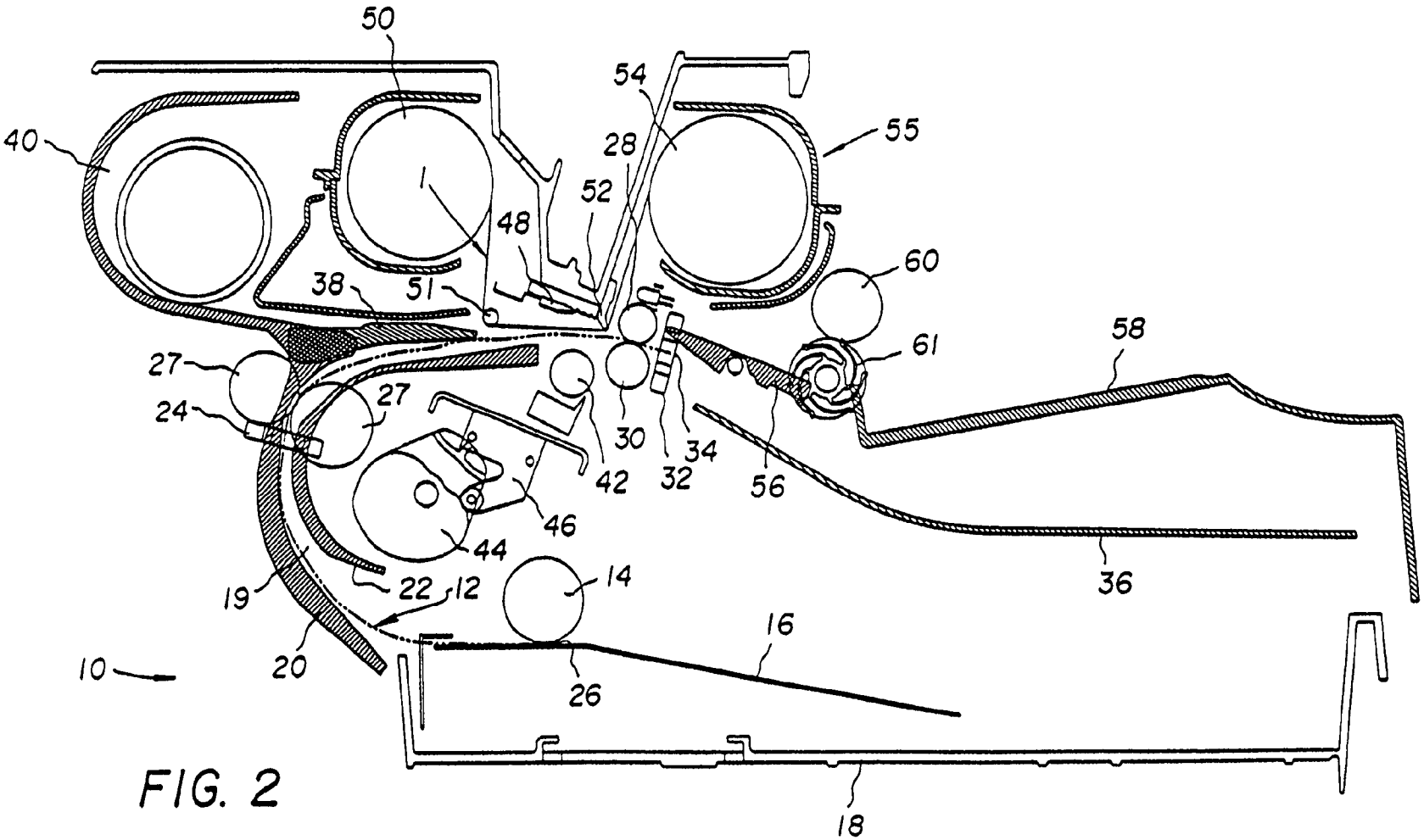
FIG. 2 is an elevation view, partly in section, of a dye transfer or thermal printer, showing a beginning or initialization cycle during a printer operation.

Beginning with FIG. 2, the dye receiver sheet 12 is initially advanced forward via motorized coaxial pick rollers 14 (only one shown) off a floating platen 16 in a tray 18 and into a channel 19 defined by a pair of curved longitudinal guides 20 and 22. When a trailing (rear) edge sensor 24 midway in the channel 19 senses a trailing (rear) edge 26 of the dye receiver sheet 12, it activates at least one of pair of motorized parallel-axis urge rollers 27, 27 in the channel 19. The activated rollers 27, 27 then advance the dye receiver sheet 12 forward (to the right in FIG. 2) through the nip of a motorized capstan roller 28 and a pinch roller 30, positioned beyond the channel 19, and to a leading (front) edge sensor 32.

Figure 3:
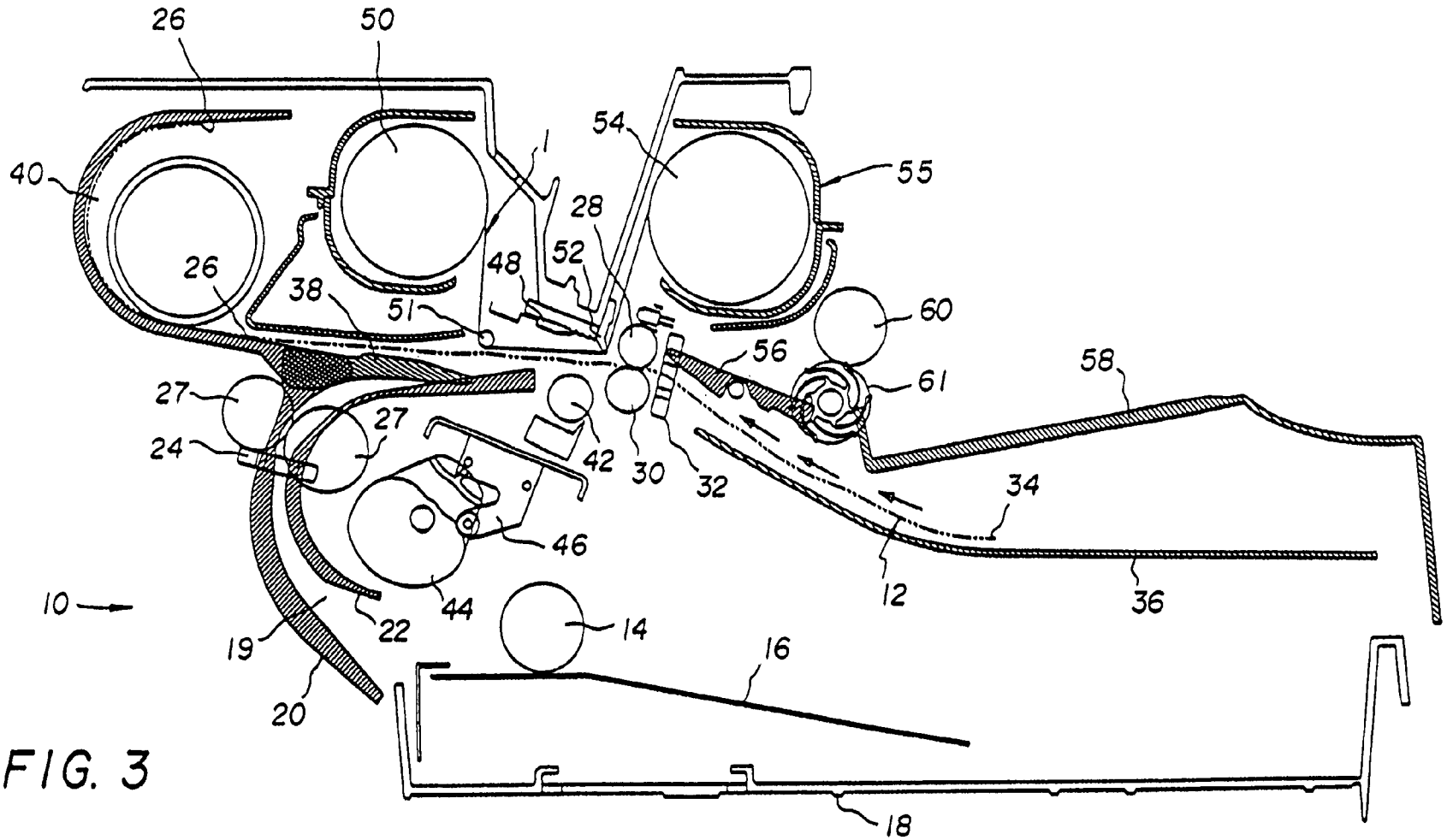
FIGS. 3 and 4 are elevation views, partly in section, of the dye transfer printer, showing successive dye transfer cycles during the printer operation.

In FIG. 3, the leading edge sensor 32 has sensed a leading (front) edge 34 of the dye receiver sheet 12 and activated the motorized capstan roller 28 to cause that roller and the pinch roller 30 to advance the dye receiver sheet forward partially onto an intermediate tray 36. The dye receiver sheet 12 is advanced forward onto the intermediate tray 36 so that the trailing (rear) edge 26 of the dye receiver sheet can be moved beyond a hinged exit door 38 that is a longitudinal extension of the curved guide 20. Then, as illustrated, the hinged exit door 38 closes and the capstan and pinch rollers 28 and 30 are reversed to advance the dye receiver sheet 12 rearward, i.e. rear edge 26 first, partially into a rewind chamber 40.

Successive Yellow, Magenta and Cyan Dye Transfers

To make a multi-color image print, respective color dyes in the dye transfer areas 5 of a single series of yellow, magenta and cyan color sections 2, 3 and 4 on the dye donor web 1 must be successively heat-transferred in superimposed relation onto the dye receiver sheet 12. This is shown beginning in FIG. 4.

Figure 4:
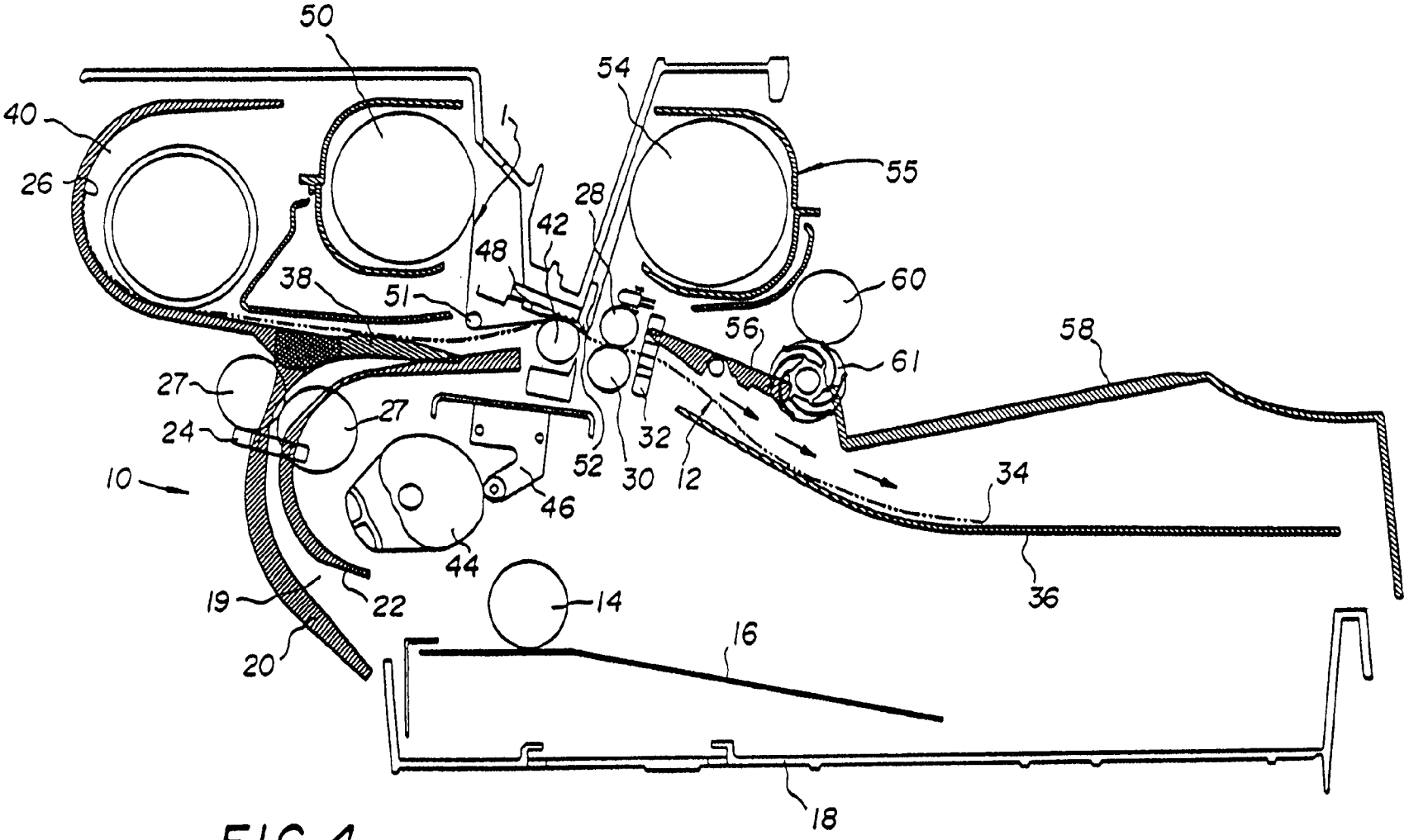
Figure 5:
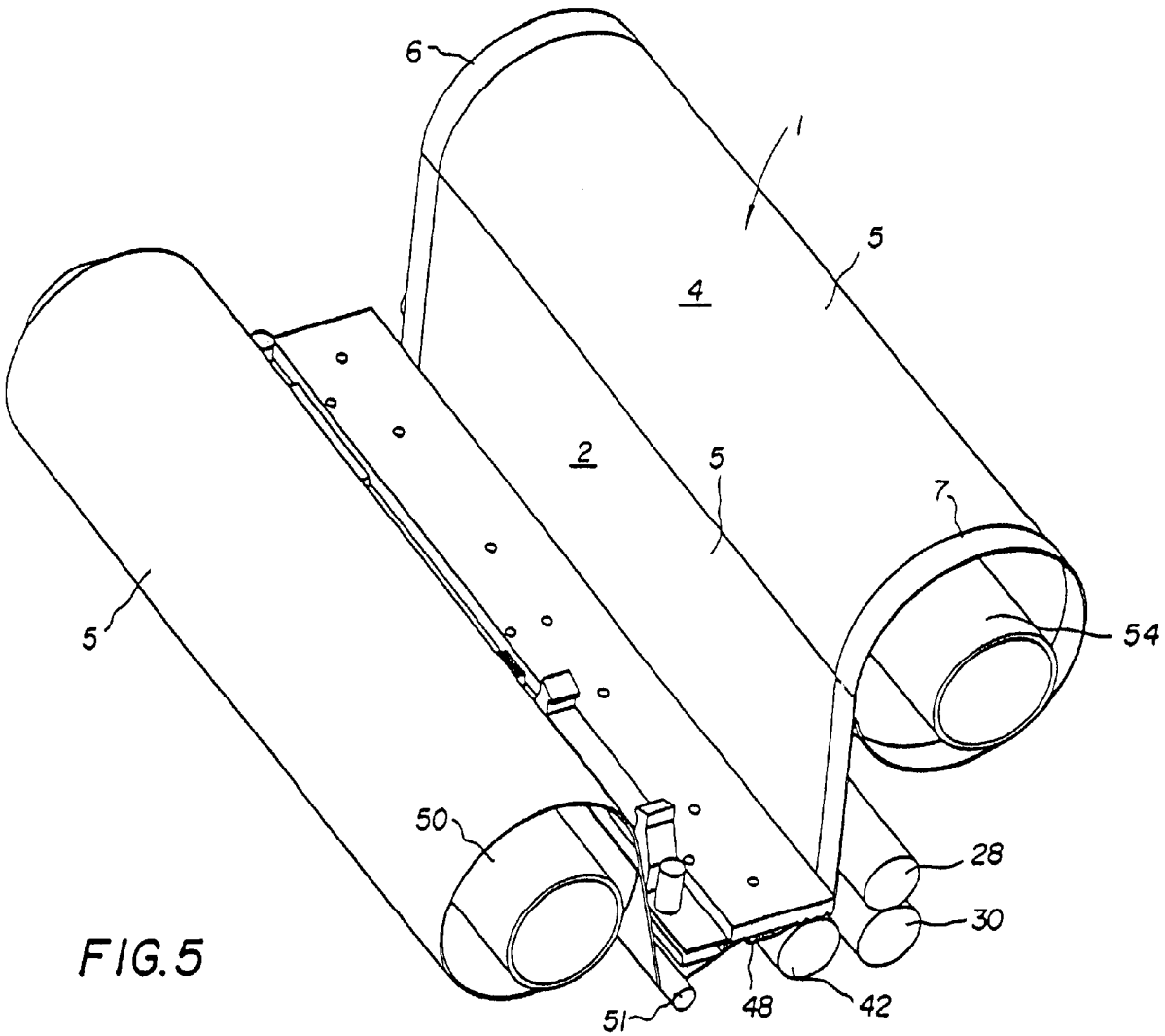
FIG. 5 is perspective view of a printing or dye transfer station in the dye transfer printer.

In FIG. 4, a platen roller 42 is shifted via a rotated cam 44 and a platen lift 46 to adjacent a thermal print head 48. This causes the dye receiver sheet 12 and an unused (fresh) yellow color section 2 of the dye donor web 1 to be locally held together between the platen roller 42 and the print head 48. The motorized capstan roller 28 and the pinch roller 30 are reversed to again advance the dye receiver sheet 12 forward to begin to return the receiver sheet to the intermediate tray 36. At the same time, the dye donor web 1 is moved forward from a donor web supply spool 50, over a first stationary donor web guide bar 51, over the print head 48, and over a second stationary donor web guide bar or stripper 52. This is accomplished by a motorized donor web take-up spool 54 that incrementally (progressively) pulls or draws the dye donor web forward. The donor web supply and take-up spools 50 and 54 together with the dye donor web 1 may be provided in a replaceable donor web cartridge 55 that is manually loaded into the printer 10.

Figure 7:
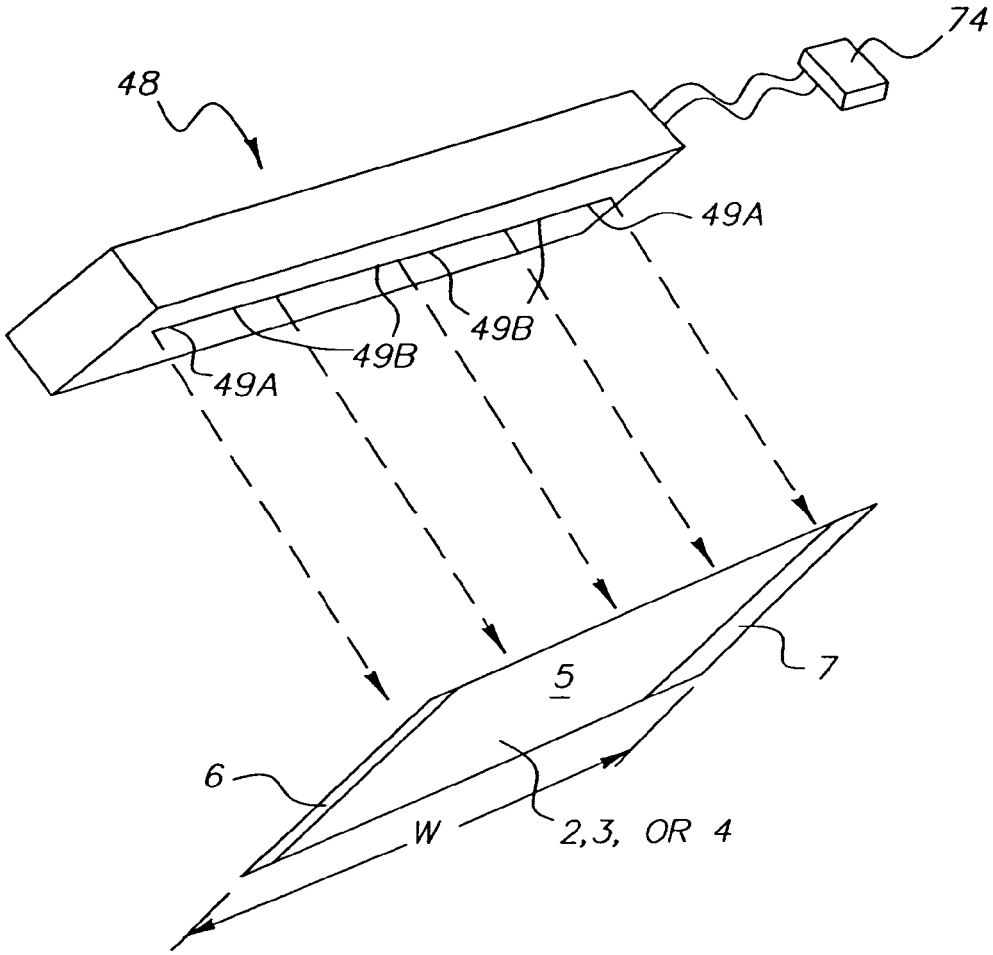
FIG. 7 is a perspective view of a bead of selectively heated resistive elements on a thermal print head in the dye transfer printer.

When the yellow color section 2 of the dye donor web 1 is pulled forward over the print head 48 in FIG. 4, the yellow color dye in the dye transfer area 5 of that color section is heat-transferred onto the dye receiver sheet 12. The yellow color dye in the two edge areas 6 and 7 of the yellow color section 2, which are alongside the dye transfer area 5, is not heat-transferred onto the dye receiver sheet 12. In this connection, the print head 48 has a bead of selectively heated, closely spaced, resistive elements 49A, 49A, . . . , 49B, 49B, . . . , 49A, 49A, . . . on the print head 48 that make contact across the entire width W of the yellow color section 2, i.e. across its dye transfer area 5 and the two edge areas 6 and 7 alongside the transfer area. As shown in FIG. 7, the resistive elements 49A make contact with the edge areas 6 and 7 and the resistive elements 49B make contact with the dye transfer area 5. However, only the resistive elements 49B are selectively heated sufficiently to effect the yellow dye transfer from the dye transfer area 5 to the dye receiver sheet 12. The yellow dye transfer is done line-by-line, i.e. row-by-row, widthwise across the dye transfer area 5. The resistive elements 49A are not heated (or only slightly heated) so that there is no yellow dye transfer from the edge areas 6 and 7 to the dye receiver sheet 12.

A known heat activating control 74, preferably including a suitably programmed microcomputer using known programming techniques, is connected individually to the resistive elements 49A, 49A, . . . , 49B, 49B, . . . , 49A, 49A, . . . , to selectively heat those resistive elements 49B that make contact with the dye transfer area 5, and preferably not heat (or only slightly heat) those resistive elements 49A that make contact with the two edge areas 6 and 7 alongside the dye transfer area. See FIG. 7.

As the yellow color section 2 of the dye donor web 1 is used for dye transfer line-by-line, it is pulled forward from the print head 48 and over the second stationary donor web guide bar or stripper 52 in FIG. 4. Then, once the yellow dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet 12 rearward, i.e. trailing (rear) edge 26 first, partially into the rewind chamber 40. See FIG. 3.

Then, the dye transfer onto the dye receiver sheet 12 is repeated line-by-line in FIG. 4, but this time using an unused (fresh) magenta color section 3 of the dye donor web 1 to heat-transfer the magenta color dye from the dye transfer area 5 of that color section onto the dye receiver sheet. The magenta dye transfer is superimposed on the yellow dye transfer on the dye receiver sheet 12.

Once the magenta dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet rearward, i.e. trailing (rear) edge 26 first, partially into the rewind chamber 40. See FIG. 3.

Then, the dye transfer onto the dye receiver sheet 12 is repeated line-by-line in FIG. 4, but this time using an unused (fresh) cyan color section 4 of the dye donor web 1 to heat-transfer the cyan color dye from the dye transfer area 5 of that color section onto the dye receiver sheet. The cyan dye transfer is superimposed on the magenta and yellow dye transfers on the dye receiver sheet 12.

Once the cyan dye transfer onto the dye receiver sheet 12 is completed, the platen roller 42 is shifted via the rotated cam 44 and the platen lift 46 from adjacent the print head 48 to separate the platen roller from the print head, and the motorized capstan roller 28 and the pinch roller 30 are reversed to advance the dye receiver sheet rearward, i.e. trailing (rear) edge 26 first, partially into the rewind chamber 40. See FIG. 3.

Final

Figure 6:
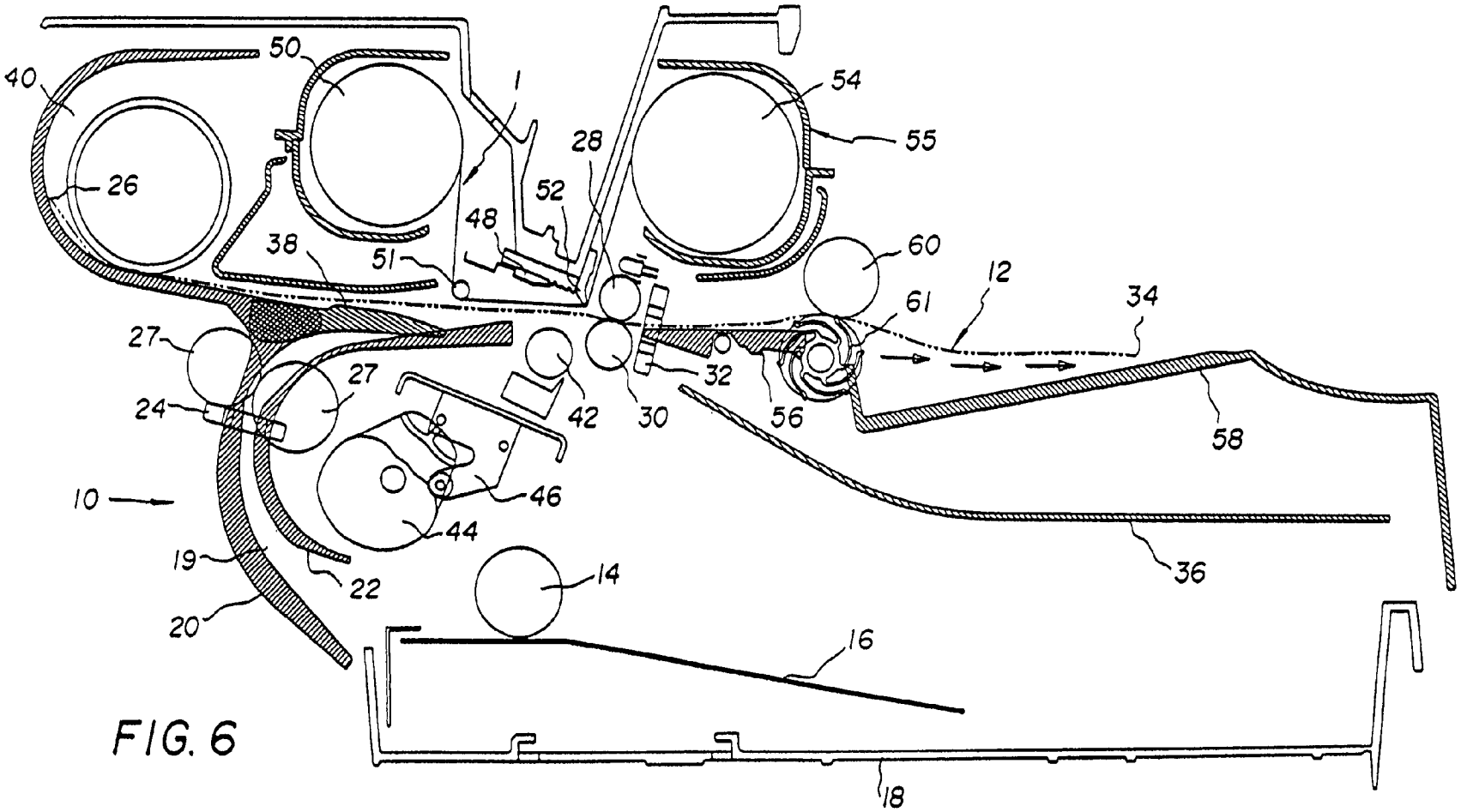
FIG. 6 is an elevation view, partly in section, of the dye transfer printer, showing a final cycle during the printer operation.

Finally, as shown in FIG. 6, the platen roller 42 remains separated from the print head 48 and the motorized capstan roller 28 and the pinch roller 30 are reversed to advance the dye receiver sheet 12 forward. However, in this instance a diverter 56 is pivoted to divert the dye receiver sheet 12 to an exit tray 58 instead of returning the receiver sheet to the intermediate tray 36 as in FIG. 4. A pair of parallel axis exit rollers 60 and 61 aid in advancing the receiver sheet 12 into the exit tray 58.

Prior Art Problem

Figure 8:
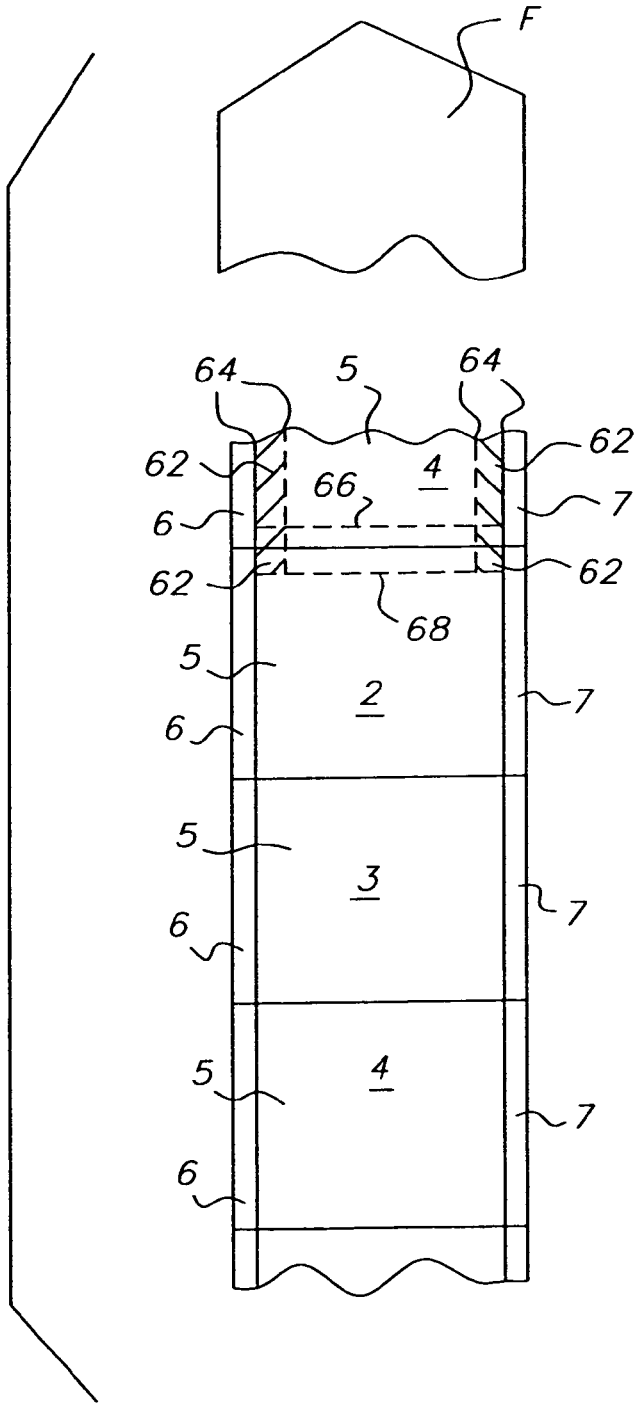
FIG. 8 (PRIOR ART)
FIG. 8 is a plan view of a portion of the dye donor web, showing creases or wrinkles spreading rearward from a trailing (rear) end portion of a used dye transfer area into a leading (front) end portion of an unused dye transfer area in the next (fresh) color section to be used, as in the prior art.

Typically in prior art dye transfer, as each yellow, magenta and cyan color section 2, 3 and 4, including its dye transfer area 5 and the two edge areas 6 and 7 alongside the transfer area, is pulled or drawn forward over the bead of selectively heated resistive elements 49A, 49A, . . . , 49B, 49B, . . . , 49A, 49A, . . . , the color section is subjected to a longitudinal tension imposed substantially by a uniform or substantially uniform forward pulling force F of the motorized donor web take-up spool 54. See FIG. 8. Moreover, since the dye transfer area 5 is heated by the resistive elements 49B, but the two edge areas 6 and 7 alongside the transfer area are not heated by the resistive elements 49A, the dye transfer area is significantly weakened in relation to the two edge areas and therefore becomes more susceptible or vulnerable to being stretched than the edge areas. See FIG. 7. Consequently, the longitudinal tension imposed by the forward pulling force F of the motorized take-up spool 54 can longitudinally stretch the dye transfer area 5 relative to the two edge areas 6 and 7. This stretching causes the dye transfer area 5 to become thinner than the non-stretched edge areas 6 and 7, which in turn causes slanted creases or wrinkles 62 to develop in the dye transfer area, mostly in those regions 64 of the dye transfer area that are close to the two edge areas. See FIG. 8. The slanted creases or wrinkles 62 occur mostly in the regions 64 of the dye transfer area 5 that are close to the two edge areas 6 and 7 because of the sharp, i.e. abrupt, transition between the weakened transfer area and the stronger edge areas, and they generally are inclined at an approximately 45° acute angle to diagonally extend forward at least within each region.

Figure 9:
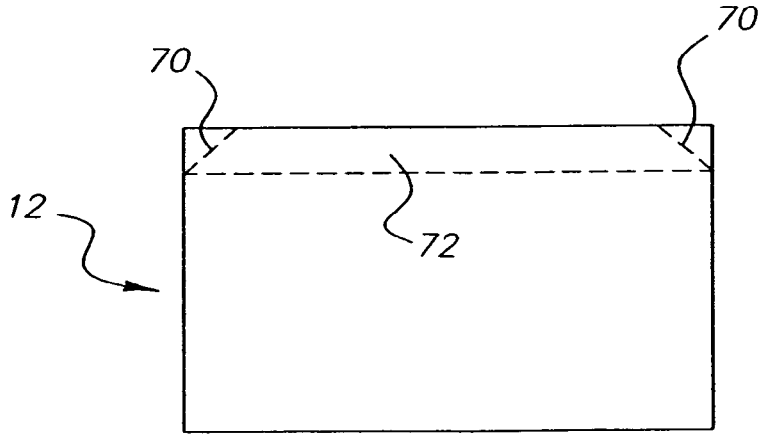
FIG. 9 (PRIOR ART)
FIG. 9 is a plan view of a dye receiver sheet, showing line artifacts printed on a leading (front) edge portion of the dye receiver sheet, as in the prior art.

As the dye donor web 1 is pulled by the motorized donor web take-up spool 54 over the bead of selectively heated resistive elements 49A, 49A, . . . , 49B, 49B, . . . , 49A, 49A, . . . , the slanted creases or wrinkles 62 tend to spread rearward from a trailing (rear) end portion 66 of a used dye transfer area 5 at least to a leading (front) end portion 68 of the next dye transfer area to be used. See FIG. 8. A problem that can result is that the slanted creases or wrinkles 62 in the leading or front end portion 68 of the next dye transfer area 5 to be used will cause undesirable line artifacts 70 to be printed on a leading (front) end portion 72 of the dye receiver sheet 12, when the dye transfer occurs at the creases in the leading end portion of the next transfer area to be used. See FIG. 9. The line artifacts 70 printed on the dye receiver sheet 12 are relatively short, but quite visible.

The question presented therefore is how to solve the problem of the slanted creases or wrinkles 62 being created in an unused transfer area 5 so that no line artifacts 70 are printed on the dye receiver sheet 12 during the dye transfer.

Solution

As previously mentioned, before each yellow, magenta or cyan dye transfer onto the dye receiver sheet 12, the platen roller 42 is shifted via the rotated cam 44 and the platen lift 46 to adjacent the print head 48. This causes the dye receiver sheet 12 and an unused (fresh) yellow, magenta or cyan color section 2, 3 or 4 of the donor web 1 to be locally held together between the platen roller 42 and the print head 48. The platen roller 42 shown in FIGS. 2–6 is an ordinary roller and, as such, it is substantially ineffective to prevent the slanted creases 62 from forming in the dye transfer area 5, including in the regions 64 of the dye transfer area that are close to the two edge areas 6 and 7, during the dye transfer. See FIG. 8.

Figure 10:
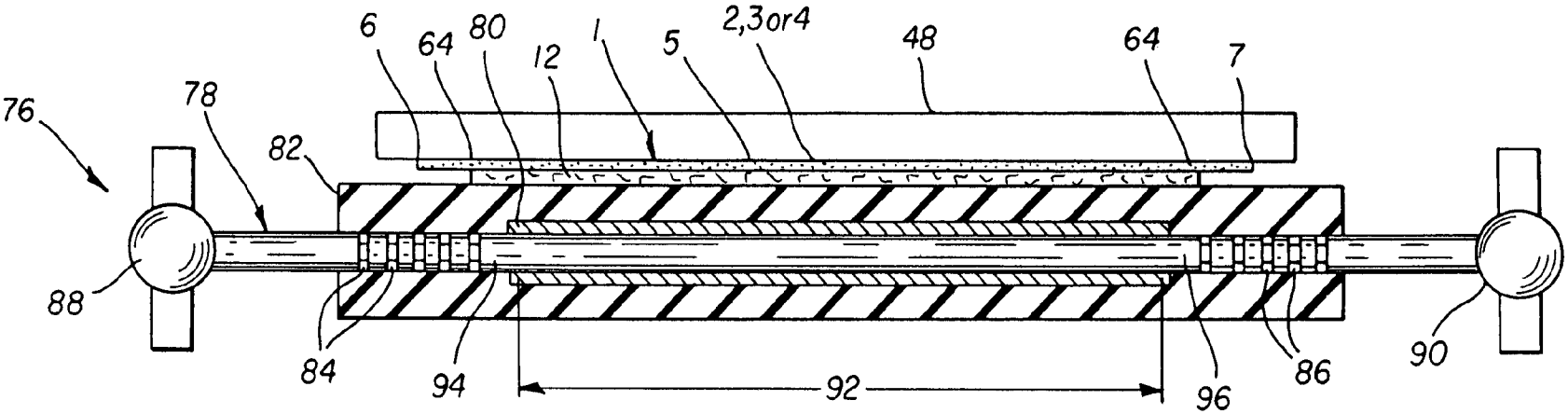
FIG. 10 is an elevation section view of a crease-preventing web roller in the dye transfer printer according to a preferred embodiment of the invention.

According to a preferred embodiment of the invention, shown in FIG. 10, there has been devised a crease-preventing web roller 76 that prevents the slanted creases 62 from forming in the dye transfer area 5, including in the regions 64 of the dye transfer area that are close to the two edge areas 6 and 7, during the dye transfer. The crease-preventing web roller 76 preferably is used in place of the platen roller 42 in FIGS. 2–6.

As shown in FIG. 10, the crease-preventing web roller 76 includes a stiff or rigid coaxial core 78 which may be a reinforced composite plastic-fiber core, a stiff or rigid coaxial sleeve 80 which may be metal, and a resilient or elastic coaxial outer cover 82 which may be rubber. The core 78 has two separate arrays or sets of annular (radial) grooves 84 and 86 successively spaced inwardly along the core from coaxial opposite ends 88 and 90 of the core. The two sets of grooves 84 and 86 extend only part-way along the core 78 in order that an intermediate portion 92 of the core is without the grooves, to make the intermediate core portion stronger than two other portions 94 and 96 of the core with the grooves, i.e. the intermediate core portion is a relatively strong or non-flexible portion and the other core portions are relatively weak or flexible. Consequently in FIG. 10, the other (weaker) portions 94 and 96 of the core 78 are able to be independently bowed or bent from the intermediate (stronger) portion 92 of the core, towards and away from the two edge areas 6 and 7 of the dye donor web 1 and the regions 64 of the dye transfer area 2, 3 or 4 in which the slanted creases 62 can form. Since the rigid sleeve 80 only covers the intermediate (stronger) core portion 92, it does not prevent independent bowing of the other (weaker) core portions 94 and 96. The outer cover 82 covers the sleeve 80 and the other (weaker) core portions 94 and 96, and it is bowed in conformity with bowing of the other (weaker) core portions.

In the preferred embodiment, the crease-preventing web roller 76 is substituted for the platen roller 42 in FIGS. 2–6 so that it can be positioned at the print head 48 to locally support the dye receiver sheet 12 and the dye transfer area 5 and two edge areas 6 and 7 against the print head. See FIG. 10. Moreover, the opposite ends 88 and 90 of the core 78 extend sufficiently beyond the print head 48 when the web roller 76 is positioned at the print head to facilitate the weaker portions 94 and 96 of the core 78 independently bowing towards the two edge areas 6 and 7 and the regions 64 of the dye transfer area 2, 3 or 4 in which the slanted creases 62 can form. In FIG. 10, the weaker portion 94 of the core 78 can be slightly bent clockwise from the intermediate (stronger) portion 92 of the core, and the weaker portion 96 of the core can be slightly bent counter clockwise from the intermediate (stronger) portion of the core. Such bending or bowing of the weaker portions 94 and 96 occurs only when the web roller 76 is positioned at the print head 48, and is due to the load of the print head on the web roller. That is, the load of the print head 48 causes the weaker portion 94 of the core 78 to be slightly bent clockwise from the intermediate (stronger) portion 92 of the core, and the weaker portion 96 of the core to be slightly bent counter clockwise from the intermediate (stronger) portion of the core. Once the web roller 76 is retracted from the print head 48, the weaker core portions 94 and 96 straighten.

When the weaker portions 94 and 96 of the core 78 are independently slightly bowed toward the two edge areas 6 and 7 and the regions 64 of the dye transfer area 2, 3 or 4 in which the slanted creases 62 can form, the crease-preventing web roller 76 is bowed at least against the two edge areas to urge the regions in which the slanted creases can form to spread in opposition to the onset of the slanted creases in such regions. Consequently, the line artifacts 70 show in FIG. 9 will not be printed on the dye receiver sheet 12 as in the prior art.

The invention has been described in detail with particular reference to certain preferred embodiments thereof, but it will be understood that variations and modifications can be effected within the spirit and scope of the invention. For example, the annular grooves 84 and 86 can extend into the intermediate (stronger) core portion 92.

PARTS LIST

1. dye donor web
2. yellow color section
3. magenta color section
4. cyan color section
5. dye transfer area
6. longitudinal edge area
7. longitudinal edge area
W. dye donor web width
10. thermal dye transfer printer
12. dye receiver sheet
14. pick rollers
16. platen
18. tray
19. channel
20. longitudinal guide
22. longitudinal guide
24. trailing edge sensor
26. trailing edge
27. urge rollers
28. capstan roller
30. pinch roller
32. leading edge sensor
34. leading or front edge
36. intermediate tray
38. exit door
40. rewind chamber
42. platen roller
44. cam
46. platen lift
48. thermal print head
49A, 49B. resistive elements
50. donor web supply spool
51. first stationary (fixed) donor web guide
52. second stationary (fixed) donor web guide
54. donor web take-up spool
55. donor web cartridge
56. diverter
58. exit tray
60. exit roller
61. exit roller
F. forward pulling force
62. slanted creases or wrinkles
64. donor web regions
66. trailing or rear end portion
68. leading or front end portion
70. line artifacts
72. leading or front end portion
74. heat activating control
76. crease-preventing web roller
78. coaxial core
80. coaxial sleeve
82. coaxial outer cover
84. annular grooves
86. annular grooves
88. coaxial opposite end
90. coaxial opposite end
92. intermediate (stronger) core portion
94. other (weaker) core portion
96. other (weaker) core portion

What is claimed is:

1. A thermal printer capable of preventing crease formation in a dye transfer area of a dye donor web that can cause line artifacts to be printed on a dye receiver during a dye transfer from the dye transfer area to the dye receiver, said printer comprising:

a thermal print head adapted to heat the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas to possibly form creases extending at least across respective regions of the dye transfer area adjacent the two edge areas; and a crease-preventing web roller that is bowed at least against the two edge areas of the dye donor web to urge the regions of the dye transfer area in which the creases can form to spread in opposition to the onset of creases in such regions.

2. A thermal printer as recited in claim 1, wherein said web roller is a platen roller that can be positioned at said print head to locally support the dye receiver, the dye transfer area, and the two edge areas of the dye donor web against said print head, and that has opposite coaxial ends extending sufficiently beyond said print head when said platen roller is positioned at said print head to permit said web roller to bow at least against the two edge areas of the dye donor web.

3. A thermal printer as recited in claim 2, wherein said web roller has respective roller portions that extend part-way inwardly from said coaxial ends of said web roller and that are sufficiently weakened to permit them to be bowed at least against the two edge areas of the dye donor web.

4. A thermal printer as recited in claim 3, wherein said web roller has a relatively strong intermediate portion between said weak roller portions that remains straight when said weak roller portions are bowed at least against the two edge areas of the dye donor web.

5. A thermal printer as recited in claim 1, wherein said web roller includes a coaxial core with relatively weak portions that extend along said core inwardly from opposite coaxial ends of said core and with a relatively strong intermediate portion between said weak core portions, to allow said weak core portions to be independently bent from said strong core portion towards the two edge areas of the dye donor web and the regions of the dye transfer area in which the creases can form.

6. A thermal printer as recited in claim 1, wherein said roller includes a coaxial core having annular grooves successively spaced inwardly along said core from coaxial opposite ends of said core, but only part-way along said core in order that an intermediate portion of said core is without said grooves, to make said intermediate core portion stronger than other core portions with said grooves, so that said core portions with said grooves can be independently bent from said intermediate core portion towards the two edge areas of the dye donor web and the regions of the dye transfer area in which the creases can form.

7. A thermal printer as recited in claim 6, wherein said roller includes a coaxial sleeve that is rigid to prevent said sleeve from being bowed and that is arranged on said coaxial core to cover said intermediate portion of said core without said grooves and not cover said portions of said core with said grooves.

8. A thermal printer as recited in claim 7, wherein said roller includes a coaxial outer cover that covers said sleeve and said portions of said core with said grooves and that is resilient.

9. A thermal printer capable of preventing crease formation in a dye transfer area of a dye donor web that can cause line artifacts to be printed on a dye receiver during a dye transfer from the dye transfer area to the dye receiver, said printer comprising:

a thermal print head adapted to heat the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas to possibly form creases extending at least across respective regions of the dye transfer area adjacent the two edge areas; and a crease-preventing web roller having relatively weak roller portions that extend part-way inwardly from opposite coaxial ends of said web roller, to be bowed at least against the two edge areas of the dye donor web to urge the regions of the dye transfer area in which the creases can form to spread in opposition to the onset of creases in such regions, and having a relatively strong intermediate roller portion between said weak roller portions that remains straight when said weak roller portions are bowed.

10. A method in a thermal printer of preventing crease formation in a dye transfer area of a dye donor web that can cause line artifacts to be printed on a dye receiver during a dye transfer from the dye transfer area to the dye receiver, said method comprising:

heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas to possibly form creases extending at least across respective regions of the dye transfer area adjacent the two edge areas; and bowing a crease-preventing web roller at least against two edge areas of the dye donor web to urge the regions of the dye transfer area in which the creases can form to spread in opposition to the onset of creases in such regions.

11. A method as recited in claim 10, wherein the web roller is moved to be positioned at the print head in order to locally support the dye receiver, the dye transfer area, and the two edge areas of the dye donor web against the print head, and is bowed only when the web roller is positioned at the print head.

12. A method in a thermal printer of preventing crease formation in a dye transfer area of a dye donor web that can cause line artifacts to be printed on a dye receiver during a dye transfer from the dye transfer area to the dye receiver, said method comprising:

heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas to possibly form creases extending at least across respective regions of the dye transfer area adjacent the two edge areas; and independently bowing relatively weak portions of a crease-preventing web roller that extend inward from opposite coaxial ends of the web roller, at least against the two edge areas of the dye donor web to urge the regions of the dye transfer area in which the creases can form to spread in opposition to the onset of creases in such regions, but not bowing a relatively strong intermediate portion of the web roller between the weak roller portions, to allow the weak roller portions to be independently bowed relative to the strong roller portion.

13. A method as recited in claim 12, wherein the weak portions of the web roller are independently bowed only when the web roller is positioned at the print head to locally support the dye receiver, the dye transfer area, and the two edge areas of the dye donor web against the print bead.

14. A method as recited in claim 13, wherein the weak portions of the web roller are weakened by annular grooves successively spaced part-way inwardly from opposite coaxial ends of the roller.

* * * * *